US009435165B2

(12) United States Patent
DeWesee, Jr. et al.

(10) Patent No.: US 9,435,165 B2
(45) Date of Patent: Sep. 6, 2016

(54) ROTATING FLOW HEAD APPARATUS

(71) Applicant: Smith International, Inc., Houston, TX (US)

(72) Inventors: William Anthony DeWesee, Jr., Burns, TX (US); Richard David Peer, Katy, TX (US)

(73) Assignee: Smith International, Inc., Houston, TX (US)

( * ) Notice: Subject to any disclaimer, the term of this patent is extended or adjusted under 35 U.S.C. 154(b) by 262 days.

(21) Appl. No.: 14/173,726

(22) Filed: Feb. 5, 2014

(65) Prior Publication Data

US 2014/0216721 A1 Aug. 7, 2014

Related U.S. Application Data

(60) Provisional application No. 61/760,853, filed on Feb. 5, 2013.

(51) Int. Cl.
*E21B 23/00* (2006.01)
*E21B 33/08* (2006.01)

(52) U.S. Cl.
CPC ..... *E21B 23/00* (2013.01); *E21B 33/085* (2013.01)

(58) Field of Classification Search
CPC .... E21B 23/02; E21B 33/035; E21B 33/038; E21B 33/085; E21B 33/06; E21B 33/064
See application file for complete search history.

(56) References Cited

U.S. PATENT DOCUMENTS 3,411,584 A * 11/1968 Sizer ..... E21B 34/105 166/322
3,489,221 A * 1/1970 Holbert, Jr. ..... E21B 43/101 166/208
3,510,153 A * 5/1970 Newton ..... E21B 33/038 285/18
3,741,589 A * 6/1973 Herd ..... E21B 23/02 285/123.4
4,018,277 A * 4/1977 Gazda ..... E21B 23/02 166/214
4,199,275 A * 4/1980 Tuson ..... B63B 35/4406 405/195.1
4,730,851 A * 3/1988 Watts ..... E21B 43/10 285/123.4
5,044,438 A * 9/1991 Young ..... E21B 17/1007 166/382
5,116,017 A * 5/1992 Granger ..... E21B 33/06 251/1.2
5,170,847 A * 12/1992 Mims ..... E21B 17/06 166/242.3
5,267,620 A * 12/1993 Lee ..... E21B 25/02 175/230
6,089,832 A * 7/2000 Patterson ..... E21B 23/02 166/68.5

(Continued)

FOREIGN PATENT DOCUMENTS

GB 2405164 A * 2/2005 ..... E21B 23/04
GB 2461178 A * 12/2009 ..... E21B 33/038

*Primary Examiner* — Jennifer H Gay
(74) *Attorney, Agent, or Firm* — David J. Smith

(57) ABSTRACT

An apparatus comprises a mandrel having a longitudinal axis and further comprises a plurality of pivoting elements spaced apart along a circumference of a cross-section of the mandrel. Each of the pivoting elements is pivotable around a transversal axis that is perpendicular to the longitudinal axis.

19 Claims, 4 Drawing Sheets

(56) References Cited

U.S. PATENT DOCUMENTS 6,230,824 B1 * 5/2001 Peterman ..... E21B 21/001 166/359
6,457,749 B1 * 10/2002 Heijnen ..... E21B 23/02 285/307
8,322,432 B2 * 12/2012 Bailey ..... E21B 33/085 166/338
9,057,239 B2 * 6/2015 Young ..... E21B 23/00
2005/0001427 A1 * 1/2005 Liew ..... F16L 37/002 285/322
2011/0266006 A1 * 11/2011 Lacheny ..... E21B 33/038 166/379
2012/0000664 A1 * 1/2012 Nas ..... E21B 33/085 166/344
2012/0085545 A1 4/2012 Tarique et al.
2012/0177313 A1 7/2012 Beauchamp et al.
2013/0299193 A1 * 11/2013 Duong ..... E21B 33/04 166/382
2014/0144650 A1 * 5/2014 Yates ..... E21B 33/038 166/379
2014/0216721 A1 * 8/2014 DeWesee, Jr. ..... E21B 23/00 166/117.5
2015/0069755 A1 * 3/2015 Bull ..... E21B 33/038 285/406
2015/0184476 A1 * 7/2015 Robertson ..... E21B 29/00 166/297
2015/0368998 A1 * 12/2015 Hart ..... E21B 33/038 166/345

* cited by examiner

ROTATING FLOW HEAD APPARATUS

CROSS-REFERENCE TO RELATED APPLICATIONS

This application claims the benefit of U.S. Provisional Application No. 61/760,853, which was filed Feb. 5, 2013 and is titled "Running Tool for Rotating Control Device Bearing", the entire disclosure of which is hereby incorporated herein by reference.

BACKGROUND

In drilling wellbores through subsurface formations, e.g., for extraction of materials such as hydrocarbons, a string of drill pipe and drilling tools is turned with a drill bit at a lower end thereof to cut through the formations. Drilling fluid may be pumped through the drill pipe and drilling tools from the surface, exit through the drill bit and return to the surface from an annular space between the wellbore wall and the drill pipe and drilling tools.

Certain drilling operations utilize a device called a rotating flow head (RFH) or a rotating control device (RCD) to seal an upper portion of the annular space and provide a discharge port for fluid leaving the annular space that enables control of discharge of the fluid from the annular space.

Rotating flow heads often include a sealed bearing assembly that provides a fluid tight seal between a housing that may be mounted to a wellhead or riser and the string of drilling tools and drill pipe while enabling rotational motion and axial motion of the drill pipe and drilling tools.

During drilling operations, the sealing bearing assembly is removed from the borehole using a device known as "a running tool" in case of repair or replacement. A variety of mechanisms exist for fastening the bearing assembly to the running tool and releasing the running tool in the housing of the rotating flow head but it can be difficult to determine at the surface whether the bearing assembly is properly seated in the housing.

BRIEF DESCRIPTION OF THE DRAWINGS

Embodiments of the continuous circulation valve are described with reference to the following figures. The same numbers are used throughout the figures to reference like features and components.

DETAILED DESCRIPTION

Examples will now be described more fully hereinafter with reference to the accompanying drawings in which example embodiments are shown. Aspects may be embodied in many different forms and should not be construed as limited to the embodiments set forth herein.

A rotating flow head is an apparatus for well operations which diverts fluids such as drilling mud, surface injected air or gas and other produced wellbore fluids, into a recirculating or pressure recovery "mud" (drilling fluid) system. The rotating flow head is typically mounted directly or indirectly on top of a wellhead or a blowout preventer (BOP) stack. The BOP stack may include an annular sealing element (annular BOP) and one or more sets of rams which may be operated to sealingly engage a pipe string disposed in the wellbore through the BOP or to cut the pipe string and seal the wellbore in the event of an emergency.

Figure 1:
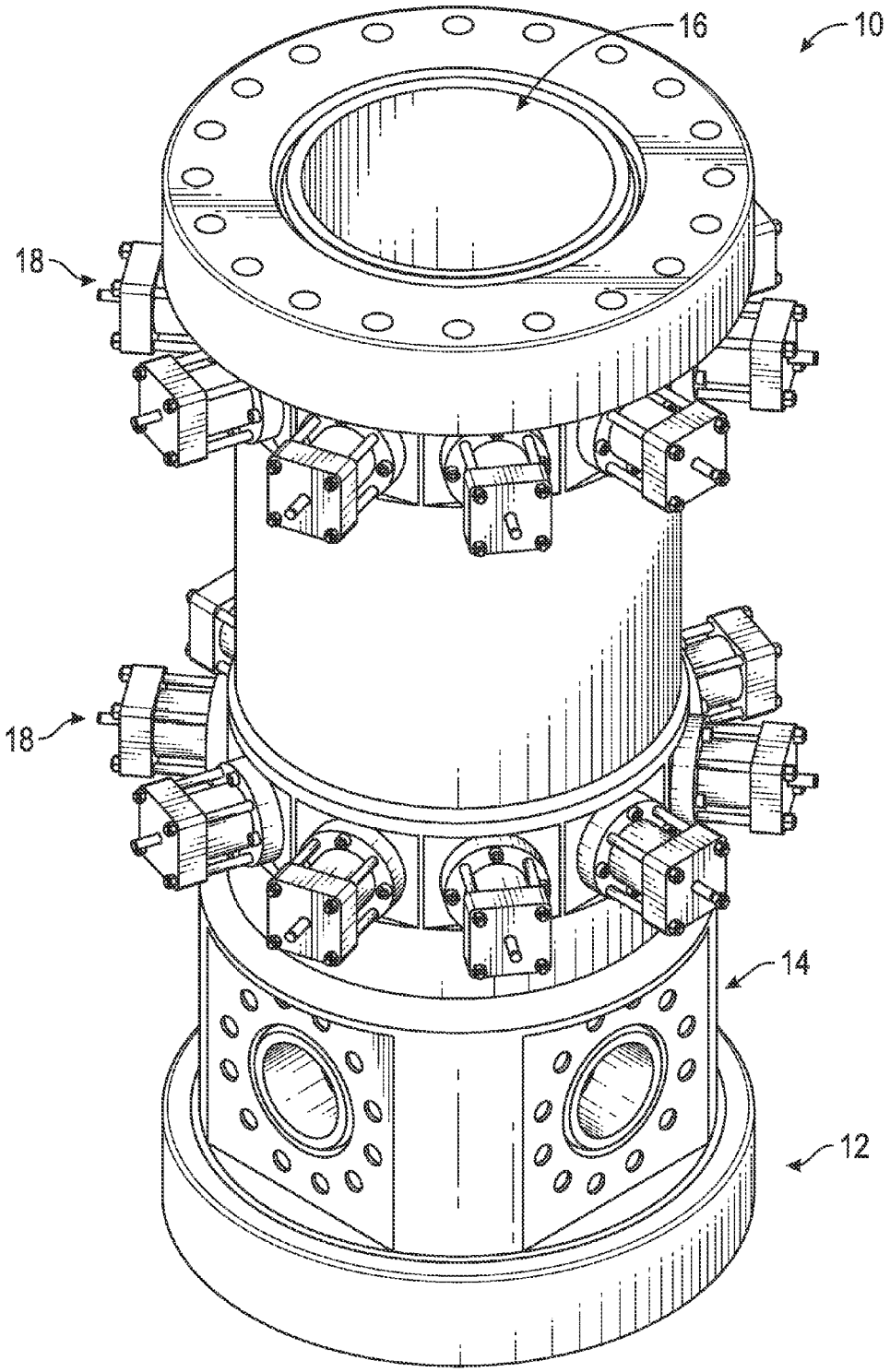
FIG. 1 is a top perspective view of an example embodiment of a housing.

As shown in the example embodiment of FIG. 1, the rotating flow head may include a housing 10 supported on a wellhead and a quill for establishing a seal to a movable tubular (not shown) such as a tubing, drill pipe or kelly. The quill is rotatably and axially supported by a bearing assembly including bearings and seal assemblies that isolate the bearing assembly from pressurized wellbore fluids.

The housing 10 of the rotating flow head, i.e., a rotating flow head (RFH) housing, may include a connector 12 at a lower end to operatively connect the housing 10 to a marine riser (not shown). The housing 10 may be connected to the marine riser at a longitudinal position above or below the riser tensioning ring (not shown). The housing 10 may further include one or more side ports 14 for redirecting wellbore fluids entering the housing 10 from below. The wellbore fluids are redirected to fluid return flow lines (not shown) hydraulically connected to a pressure recovery mud system (not shown).

The housing 10 may further include a bore 16 and fastening elements 18. The fastening elements 18 are provided to secure components of the rotating flow head (e.g., a bearing assembly) within the bore 16 of the housing 10. The fastening elements 18 may be features that extend into the bore 16 or retract therefrom to secure the components inside the bore 16. For example, the fastening elements 18 may be one or more pistons, bolts, screws or the like. The extension and retraction of the fastening elements 18 may be remotely controllable from a console located at ground level, for example. An array of fastening elements 18 may be provided at equal intervals along the perimeter of the housing 10. The array of fastening elements 18 may be provided at each longitudinal end of the housing 10. Specifically, an upper array of fastening elements 18 and a lower array of fastening elements 18 may be provided as shown in FIG. 1.

Figure 2:
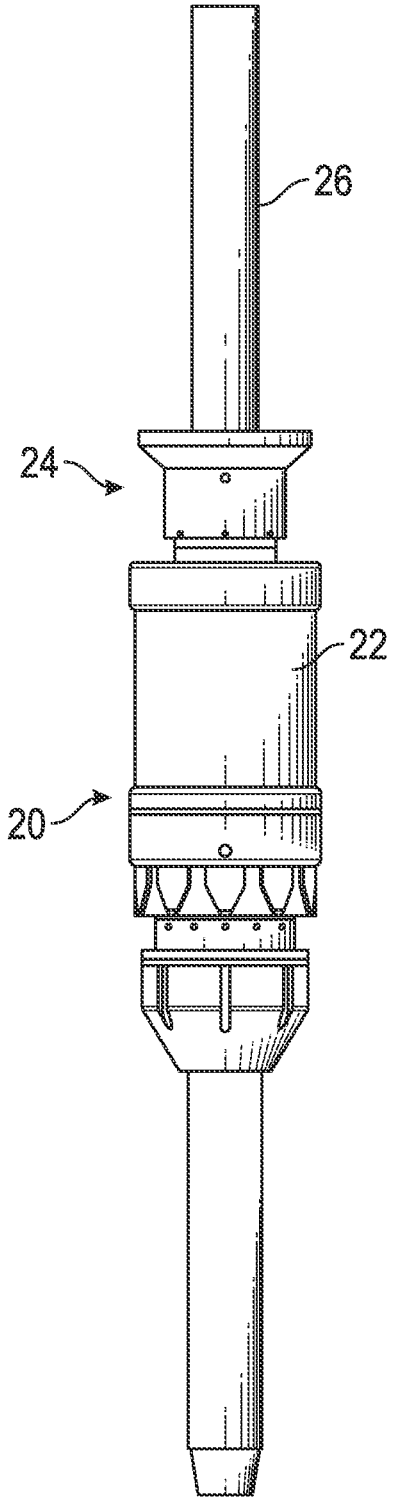
FIG. 2 is a side view of an example embodiment of a component coupled to an example embodiment of a running tool.

One example component 20 that is mounted to the housing 10 may be a removable, replaceable bearing assembly. The bearing assembly may include a bearing assembly housing 22 having therein an inner cylindrical mandrel 24 permitting sealing passage therethrough of a tubular such as a drill string. As shown in FIG. 2, the inner cylindrical mandrel 24 passes through the bearing assembly housing 22. The bearing assembly housing 22 and the inner cylindrical mandrel 24 form an annular bearing space (not shown) therebetween for fitment of bearings and sealing elements. The bearing assembly housing 22 and the inner cylindrical mandrel 24 may be secured to one another by way of a plurality of bolts at a downhole end of the bearing assembly housing 22.

The component 20 may be secured in the bore 16 by the fastening elements 18 as will be described below. As shown in FIG. 2, a running tool 26 may be used to run in (i.e., send downward from a rig floor) the component 20 to the housing 10 of the rotating flow head mounted on the BOP stack, for example. Also, the running tool 26 may be used to retrieve the component 20 from the housing 10 of the rotating flow head back to the rig floor. The running tool 26 may be a single tool having these dual functions (i.e., both running in and retrieving the bearing assembly) or may be two separate tools each having a single function (i.e., running in or retrieving the component 20). In an example embodiment, the running tool 26 may be used to install a component 20 within the housing 10. In another example, the running tool 26 may be used to remove or retrieve the component 20 from the housing 10.

Figure 4:
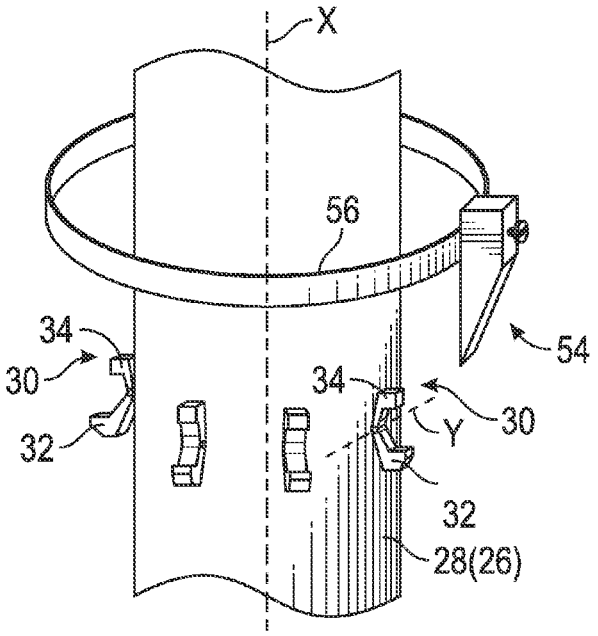
FIG. 4 is a perspective view of the running tool with example pivoting elements and a wedging apparatus.
Figure 5:
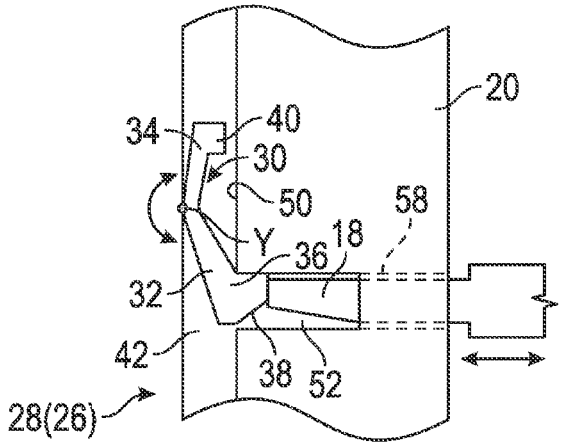
FIG. 5 is a side view of one of the fastening elements extending through an aperture formed on the component to actuate one of the pivoting elements.

The running tool 26 may be elongate and may include a mandrel 28 around which a component 20 may be mounted. In one example, the mandrel 28 may include one or more pivoting elements 30 (FIGS. 4-5 which are not drawn to scale). The component 20 may be engaged by and secured to the running tool 26 by way of these pivoting elements 30. The pivoting elements 30 may be spaced apart at equal intervals along the circumference of the cross-section of the mandrel 28. The pivoting element 30 may be bent at an angle at an intermediate portion. A pivot point around which the pivoting element 30 may pivot is located at the intermediate portion. As shown in FIG. 4, the pivoting element 30 may be configured to pivot around a transversal axis Y that is perpendicular to a longitudinal axis X of the running tool 26. The longitudinal axis X may pass through a cross-sectional center of the running tool 26.

As shown in FIG. 4, the pivoting element 30 may include a first arm 32 and a second arm 34 that intersect at an angle of less than 180 degrees. The first arm 32 and the second arm 34 may intersect at the aforementioned intermediate portion. The first arm 32 may correspond to a distal portion of the pivoting element 30 with respect to the rig platform. The second arm 34 may correspond to a proximal portion of the pivoting element 30 with respect to the rig platform. The pivoting element 30 can pivot toward or away from the mandrel 28 around the transversal axis Y and can be biased to pivot in a specific rotational direction. Because of the configuration of the pivoting element 30 in which the arms 32 and 34 intersect at less than 180 degrees, as the first arm 32 is pivoted away from the mandrel 28, the second arm 34 is pivoted toward the mandrel 28. Due to the same configuration, as the first arm 32 is pivoted toward the mandrel 28, the second arm 34 is pivoted away from the mandrel 28. In an example embodiment, the firm arm 32 can be biased to pivot away from the mandrel 28 such that the second arm 34 is near or contacts the mandrel 28 in a default and first position. The pivoting elements 30 can move between the first position (in which the first arms 32 are pivoted outward and the second arms 34 are near or contact the mandrel 28) and the second position (in which the second arms 34 are pivoted outward and the first arms 32 are near or contact the mandrel 28).

As shown in FIG. 5, the first arm 32 may include a distal end 36 that projects laterally away from the longitudinal axis X. The distal end 36 may taper in a distal direction and may have an outer surface 38 that is beveled as shown in FIG. 5. In an example embodiment, the distal end 36 may have an inverted trapezoid shape. The second arm 34 may include a proximal end 40 that projects laterally away from the longitudinal axis X. The proximal end 40 that may be rectangular, trapezoidal, etc.

Figure 3:
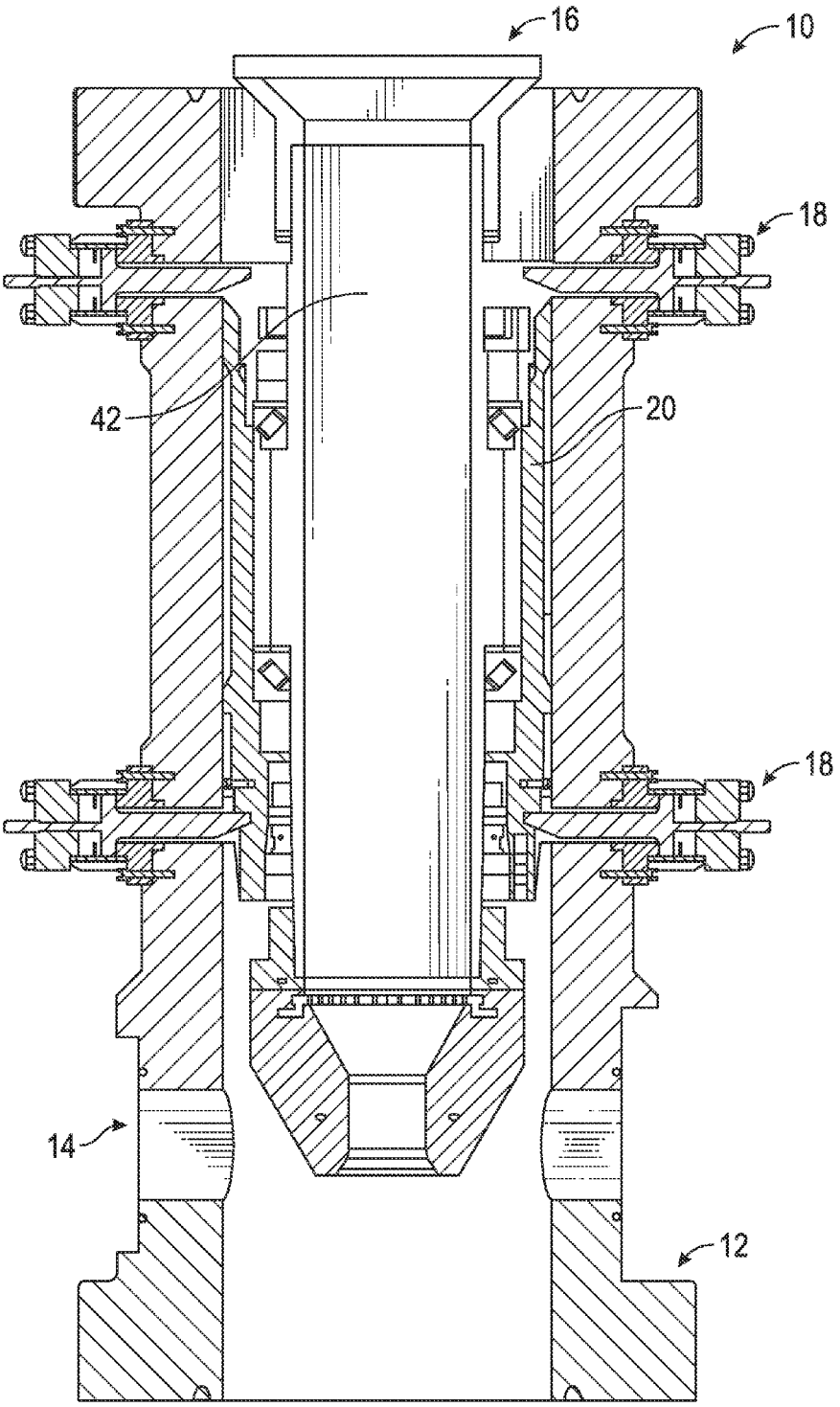
FIG. 3 is a side cross-sectional view of the component placed inside the housing where example fastening elements of the housing are shown.

The component 20 may have a cylindrical configuration and may include a hole 42 (FIG. 3) into which at least a part of the running tool 26 can be inserted. An opening 44 of the hole 42 (FIG. 6) may be defined by a rim 46. The rim 46 may be dimensioned to actuate the first arms 32 of the pivoting elements 30 as the running tool 26 is inserted into the opening 44. Specifically, as the running tool 26 is inserted into the opening 44, the tapered outer surface 38 at the distal end 36 of the first arm 32 may slide against edges 48 of the opening 44 causing the first arm 32 to be pivoted toward the mandrel 28. The component 20 may include a cap and the opening 44 may be formed on the cap. The opening 44 is dimensioned to allow the distal end 36 to pass through the opening 44 through the pivoting movement of the first arms 32. The hole 42 is dimensioned to allow the running tool 26 and the pivoting elements 30 to continue to move through the hole 42 with the pivoting elements 30 sliding against an inner surface 50 of the hole 42. In the hole 42, the component 20 has a depression 52 that can accommodate the distal end 36 of the first arm 32 as shown in FIG. 5. The depression 52 may be a groove that extends along the perimeter of the inner surface 50 of the component 20 to accommodate the distal end 36 of the first arm 32 after the first arm 32 has moved a predetermined distance into the hole 42.

Figure 6:
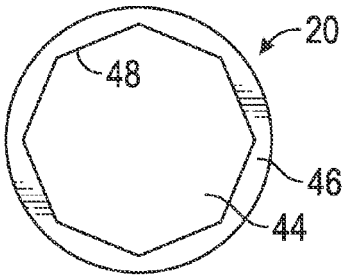
FIG. 6 is a top view of a hole of the component into which the running tool is inserted.

As shown in FIG. 6, the opening 44 of the hole 42 may have a variety of shapes such as a circle, a polygon, etc. In case of a polygon, each side of the polygon may be engaged by one of the pivoting elements 30 as the running tool 26 is inserted into the component 20.

The rim 46 of the component 20 may be sufficiently thin so as to be disposed between the distal end 36 of the first arm 32 and the proximal end 40 of the second arm 34. This would occur through the insertion of the mandrel 28 into the hole 42 and the pivoting movement of the first arms 32 once the pivoting element 30 returns to the first position. The portion of the component 20 above the depression 52 may be seated on the distal end 36 and the biasing force of the pivoting element 30 may be sufficient to resist and support the weight of the component 20 thereby making it possible for the component 20 to be retrieved from the hole 42.

Instead of actuating the pivoting element 30 through insertion of the running tool 26 into the opening 44 of the component 20, it may be possible to use a separate apparatus to secure the component 20 to the running tool 26. For example, a wedging apparatus may include a wedging element 54 (FIG. 4) that is inserted into a space between the second arms 34 and the mandrel 28 to pivot the second arms 34 outward so that the first arms 32 which are pivoted toward the mandrel 28 is insertable into the opening 44 of the component 20. The wedging apparatus may include a plurality of wedging elements 54 corresponding to each pivoting element 30 although only one wedging element 54 is shown in FIG. 4 for clarity of illustration. The wedging apparatus may include a band-like portion 56 that can be adjusted to secure the wedging apparatus around the mandrel 28. The wedging apparatus may then be secured in place using a fastening means such as a bolt inserted to contact the mandrel 28. The wedging apparatus may be used to couple the component 20 to the running tool 26 at ground surface rather than in the borehole.

Once the component 20 is secured to the running tool 26, the component 20 in engagement with the pivoting elements 30 can be inserted into the bore 16 of the housing 10. The bore 16 of the housing 10 is configured so that the component 20 can be accommodated therein in a predetermined manner in terms of depth, alignment, orientation, etc. An example method and apparatus for running in and aligning/orienting a component (e.g., a bearing assembly) in a housing (e.g., a RFH housing) is described in U.S. Patent Application Publication No. 2012/0085545 which is incorporated herein by reference.

In an example embodiment, the component 20 may include apertures 58 that may be located radially outward of the depression 52 and may be in communication with the exterior of the component 20. Moreover, the fastening elements 18 of the housing 10 may be radially aligned with the apertures 58 of the component 20 so as to be extendable therethrough to thereby secure and couple the component 20 to the housing 10. Furthermore, the fastening elements 18 may be dimensioned to extend through the apertures 58 and into the depression 52. The fastening elements 18, when extended, will actuate the pivoting elements 30 in case that the component 20 is properly mounted in the bore 16 of the housing 10. Thus, as long as the component 20 is properly mounted in the bore 16 of the housing 10 using the running tool 26, the extension of the fastening elements 18 can be used to disengage the pivoting elements 30 from the component 20 by pressing the distal ends 36 of the first arms 32 out of the depression 52.

An example manner of using the aforementioned assembly can be described as follows. The component 20 is secured to the running tool 26 by inserting the mandrel 26 into the hole 42 of the component 20. The tapered outer surface 38 of the distal end 36 is met by the edge 48 of the opening 44 and the pivoting element 30 is actuated so that the first arm 32 which is biased to pivot away from the mandrel is pivoted toward the mandrel 28. This movement of the pivoting element 30 allows the first arm 32 to move past the opening 44. After the running tool 26 has moved further into the hole 42, the distal end 38 of the first arm 32 is accommodated in the depression/groove 52 of the component 20 formed inside the hole 42. The coupling of the component 20 to the running tool 26 may be done using the wedging apparatus. Before the running tool 26 is inserted into the hole 42, the wedging apparatus is mounted on the running tool 26 to maintain the first arms 32 of the pivoting elements 30 pivoted toward the mandrel 28. The wedging apparatus can be removed after the first arms 32 are inserted past the opening 44. Thereafter, the running tool 26 is inserted further into the hole 42 until the pivoting elements 30 engage the depression 52.

Thereafter, the component 20 engaged by the pivoting elements 30 is run in down hole and is inserted into the bore 16 of the housing 10. If the component 20 becomes properly seated in the bore 16 of the housing 10, the extension of the fastening elements 18 of the housing 10 into the apertures 58 of the component 20 will actuate and disengage the pivoting elements 30 from the component 20. Contrastingly, if the component 20 is improperly seated in the bore 16, the extension of the fastening elements 18 will not disengage the pivoting elements 30 from the component 20.

As the running tool 26 is retrieved from the hole 42 after the component 20 is secured to the housing 10, the first arms 32 of the pivoting element 30 slide along the inner surface 50 of the hole 42 and exit through the opening 44, and the component 20 is left secured to the housing 10.

When it is necessary to retrieve the component 20 from the housing 10, the running tool 26 is inserted into the bore hole and is pushed into the opening 44 of the component 20 against the biasing force of the pivoting elements 30. Once the running tool 26 is sufficiently pressed into the hole and the fastening elements 30 are retracted out of the apertures 58 of the component 20, the first arms 32 of the pivoting elements 30 will enter the depression 52 and the component 20 will be coupled to the running tool 26 thereby allowing retrieval of the component 20 from the housing for replacement or repair.

In one example, a running tool includes a mandrel having a longitudinal axis and includes a plurality of pivoting elements spaced apart along a circumference of a cross-section of the mandrel. Each of the pivoting elements pivots around a transversal axis that is perpendicular to the longitudinal axis.

In another example, a rotating flow head includes a running tool, a component and a housing. The running tool includes a mandrel having a longitudinal axis and further includes a plurality of pivoting elements spaced apart along a circumference of a cross-section of the mandrel. The component is engaged by the pivoting elements. The housing includes a bore into which the component engaged by the pivoting elements of the running tool is inserted. The housing includes fastening elements that are radially aligned with the pivoting elements and are extendable so as to disengage the pivoting elements from the component.

In yet another example, a rotating flow head includes a running tool, a component and a housing. The running tool includes a mandrel having a longitudinal axis and further includes a plurality of pivoting elements spaced apart along a circumference of a cross-section of the mandrel. The component is engaged by the pivoting elements. The housing includes a bore into which the component engaged by the pivoting elements of the running tool is inserted. The housing further includes fastening elements that are radially aligned with the pivoting elements and are extendable so as to disengage the pivoting elements from the component.

Although the preceding description has been described herein with reference to particular means, materials and embodiments, it is not intended to be limited to the particulars disclosed herein. Rather, it extends to all functionally equivalent structures, methods and uses, such as are within the scope of the appended claims.

What is claimed is:

1. An apparatus comprising:

a mandrel having a longitudinal axis; and a plurality of pivoting elements spaced apart along a circumference of a cross-section of the mandrel, each of the plurality of pivoting elements pivotable around a transversal axis that is perpendicular to the longitudinal axis, wherein each of the plurality of pivoting elements comprises: a first arm that is pivotable toward or away from the mandrel around the transversal axis; and a second arm intersecting the first arm at an angle of less than 180 degrees so that the second arm is pivotable toward or away from the mandrel as the first arm pivots away from or toward the mandrel.

2. The apparatus of claim 1, wherein each of the plurality of pivoting elements is biased to pivot the first arm away from the mandrel.

3. The apparatus of claim 1, further comprising a wedging apparatus to cause the second arm to pivot away from the mandrel and the first arm to pivot toward the mandrel.

4. An apparatus comprising:

a running tool comprising a mandrel having a longitudinal axis and further comprising a plurality of pivoting elements spaced apart along a circumference of a cross-section of the mandrel;

a component comprising a hole into which the running tool is at least partly inserted, each of the plurality of pivoting elements to engage a depression formed in the hole such that the component is supported by the plurality of pivoting elements, wherein each of the plurality of pivoting elements comprises: a first arm that is pivotable toward or away from the mandrel around a transversal axis; and a second arm intersecting the first arm; and a wedging apparatus to cause the second arm to pivot away from the mandrel and the first arm to pivot toward the mandrel.

5. The apparatus of claim 4, wherein each of the pivoting elements is biased to pivot the first arm away from the mandrel.

6. The apparatus of claim 4, wherein the first arm is pivoted toward the mandrel as the running tool is inserted into the opening.

7. The apparatus of claim 6, wherein the first arm comprises a distal end that tapers in a distal direction therefrom, and the component is supported by the distal end when the first arm is inserted into the hole and is pivoted away from the mandrel.

8. The apparatus of claim 7, wherein the depression is a groove extending along a perimeter inside the hole.

9. The apparatus of claim 4, wherein the transversal axis is perpendicular to the longitudinal axis.

10. The apparatus of claim 4, wherein an opening of the hole is a polygon shape, and each side of the polygon shape is engaged by one of the pivoting elements.

11. An apparatus comprising:

a running tool comprising a mandrel with a longitudinal axis and further comprising a plurality of pivoting elements spaced apart along a circumference of a cross-section of the mandrel;

a component to be engaged by the pivoting elements; and a housing comprising a bore into which the component in engagement with the pivoting elements of the running tool is inserted, the housing further comprising fastening elements that are radially aligned with the pivoting elements and are extendable so as to disengage the pivoting elements from the component.

12. The apparatus of claim 11, wherein the component comprises apertures radially aligned with the pivoting elements, the fastening elements are radially aligned with the apertures so as to extend through the apertures and fasten the component with respect to the housing.

13. The apparatus of claim 11, wherein the component comprises a hole into which the running tool is to at least partly be inserted, each of the plurality of pivoting elements to engage a depression formed in the hole such that the component is supported by the plurality of pivoting elements.

14. The apparatus of claim 13, wherein each of the plurality of pivoting elements comprises a transversal axis about which a first arm is pivotable toward or away from the mandrel, and each of the plurality of pivoting elements is biased to pivot the first arm away from the mandrel.

15. The apparatus of claim 14, wherein the first arm is pivoted toward the mandrel as the running tool is inserted into the depression to engage the component.

16. The apparatus of claim 14, wherein the first arm comprises a distal end that tapers in a distal direction therefrom, and the component is supported by the distal end when the first arm is pivoted away from the mandrel after being inserted into the hole.

17. The apparatus of claim 14, wherein the depression is a groove extending along a perimeter inside the hole.

18. The apparatus of claim 14, wherein the transversal axis is perpendicular to the longitudinal axis.

19. The apparatus of claim 13, wherein the opening is a polygon shape, and each side of the polygon shape is engaged by one of the pivoting elements.

* * * * *